US008634781B2

(12) United States Patent
Yu

(10) Patent No.: US 8,634,781 B2
(45) Date of Patent: Jan. 21, 2014

(54) REMOTE-CONTROL METHOD AND EMITTER COOPERATED WITH PERSONAL COMMUNICATION DEVICE

(75) Inventor: Chia-Wei Yu, Taichung (TW)

(73) Assignee: Puu-Jiuh Co., Ltd., Taichung (TW)

( * ) Notice: Subject to any disclaimer, the term of this patent is extended or adjusted under 35 U.S.C. 154(b) by 463 days.

(21) Appl. No.: 13/018,087

(22) Filed: Jan. 31, 2011

(65) Prior Publication Data

US 2012/0171927 A1 Jul. 5, 2012

(30) Foreign Application Priority Data

Dec. 29, 2010 (TW) ..... 99225418 U

(51) Int. Cl.
*H04B 1/38* (2006.01)

(52) U.S. Cl.
USPC ..... 455/90.3; 455/352; 455/420

(58) Field of Classification Search
USPC ..... 455/90.3
See application file for complete search history.

(56) References Cited

U.S. PATENT DOCUMENTS

| | | | | |
|---|---|---|---|---|
| 6,915,871 | B2 * | 7/2005 | Gavish et al. | 180/167 |
| 7,956,847 | B2 | 6/2011 | Christie | 345/173 |
| 8,214,088 | B2 | 7/2012 | Lefebure | 701/2 |
| 2003/0186690 | A1 | 10/2003 | Ko | 455/420 |
| 2004/0181591 | A1 | 9/2004 | Yu et al. | 709/217 |
| 2005/0048918 | A1 | 3/2005 | Frost et al. | 455/41.2 |
| 2006/0116009 | A1 * | 6/2006 | Langberg et al. | 439/76.1 |
| 2008/0049957 | A1 * | 2/2008 | Topholm | 381/315 |
| 2010/0009735 | A1 | 1/2010 | Seydoux | 463/6 |
| 2011/0223899 | A1 * | 9/2011 | Hiraide | 455/420 |

FOREIGN PATENT DOCUMENTS

| | | | |
|---|---|---|---|
| CN | 201223731 | 4/2009 | A63H 30/04 |
| CN | 101707662 | 5/2010 | H04M 11/00 |
| TW | 346228 | 11/1998 | G08B 25/08 |
| TW | M365609 | 9/2009 | H04B 1/38 |
| TW | 201028045 | 7/2010 | H05B 37/02 |
| TW | 201038045 | 10/2010 | H04M 1/21 |
| TW | M395312 | 12/2010 | G08C 17/02 |
| WO | WO2004037368 | 5/2004 | A63H 30/04 |

OTHER PUBLICATIONS www.youtube.com, Title: Parrot AR Drone and Gyro Flyer—RC Helicopters Race—YouTube, May 14, 2013, pp. 1-2.
www.youtube.com, Title: Mobile Phone Control U.Bo Robot Using Bluetooth Communications—YouTube. Aug. 14, 2013, pp. 1-2.
www.thinkflood.com/products/redeye-mini/#technical-specifications, Title: RedEye mini: take control on the road, Aug. 14, 2013, pp. 1-7.

(Continued)

*Primary Examiner* — Ajibola Akinyemi
(74) *Attorney, Agent, or Firm* — Alan Kamrath; Kamrath IP Lawfirm, P.A.

(57) ABSTRACT

A method of a remote-control combined with a personal communication device includes an emitter having an exposed plug inserted into a reception hole of a personal communication device; and a remote-control application program downloaded from pre-set or remote servos and stored in the personal communication device. The remote-control application program is activated via the personal communication device, and the personal communication device sends a user interface sub-program to a touch panel of the personal communication device. The user interface program is activated, and the emitter emits control signals to remote-control toys. By using the personal communication device, the users conveniently play and control the remote-control toys.

15 Claims, 11 Drawing Sheets

(56) References Cited

OTHER PUBLICATIONS www.alibaba.com/product-gs/668157060/3Channel_Alloy_Mini_RC_Helicopter_777.html, Title: 3 channel Alloy Mini RC Helicopter 777-150 With Infared and Gyro, Mini Helicopter, Toys Helicopter, May 14, 2013, pp. 1-3.

* cited by examiner

REMOTE-CONTROL METHOD AND EMITTER COOPERATED WITH PERSONAL COMMUNICATION DEVICE

FIELD OF THE INVENTION

The present invention relates to software and hardware of a remote-control toy and, more particularly, to a personal communication device whose software simulates a user interface remote-control toys.

BACKGROUND OF THE INVENTION

A conventional remote-control toy is shown in FIG. 10 and generally includes a controller 9 which emits wireless radio control signals. The controller 9 includes an encoder and a wireless radio signal emitter. The control signals are emitted by operation of the direction button 91, frequency choosing button 92, button 93 and acceleration button 94 on the controller 9 to control the remote-control toys.

The latest personal communication device includes CPU, RAM and LED. The functions of the personal communication device include communication, taking photos, taking video clips, playing video files, interne browsing, sending/receiving emails, editing files and playing games, and the operation method is changed by pressing buttons into touching the panel. All of the functions mentioned above can be done by touching the touch panel.

Moreover, some personal communication devices have a g-sensor which can control the directions of the characters of the games or browsing the photos by swinging the personal communication devices.

The conventional remote-control controller is too big to carry. The functions of the modern personal communication device are so powerful, and some of the personal communication devices are equipped with the g-sensors used to control the game software. It is a goal to combine the personal communication device to the remote-control controller.

SUMMARY OF THE INVENTION

The present invention relates to an emitter connected with a personal communication device and comprises a transmission interface which is a 3.5 mm plug interface or a 30-pin plug interface. The transmission interface is connected to the personal communication device and sends control data to an encoder. The encoder encodes the control signals of the personal communication device into control signals sent to a wireless emitting/receiving module. A wireless emitting/receiving module sends the control signals from the encoder to the remote-control toys. A case includes a transmission interface, the encoder and the wireless emitting/receiving module received therein, and the case is connected with a protection cover.

The emitter comprises a protection cover mounted to the personal communication device and secured to the case of the personal communication device. The case includes the transmission interface, the encoder and the wireless emitting/receiving module. The protection cover and the case are integrally formed, and the transmission interface is located inside a long side of the personal communication device.

The protection cover and the case are integrally formed, and the protection cover includes a bending line. The transmission interface is located at an angle relative to the long side of the personal communication device. The transmission interface is located outside of the protection cover.

The emitter includes a remote-control application program stored in the memory of the personal communication device, or downloaded from a cloud operation system. The remote-control application program comprises a main program and a user interface sub-program. The user interface sub-program receive input signals from the buttons on the touch panel of the personal communication device. The main program receives signals from the user interface sub-program, calculates the signals and sends the signals to the encoder via the transmission interface of the emitter and the wireless emitting/receiving module in sequence.

The remote-control application program includes a g-sensor sub-program which receives induction signals from the g-sensor of the personal communication device and sends the induction signals to the main program.

The wireless emitting/receiving module comprises a wireless receiver, and the remote-control application program includes a learning sub-program. The learning sub-program stores remote-control frequencies from the wireless receiver or other remote-control controllers into the memory of the personal communication device. The remote-control frequencies are activated by the learning sub-program via the main program.

The user interface sub-program includes multiple direction buttons, an acceleration button and multiple frequency choosing buttons displayed on the touch panel of the personal communication device.

The user interface sub-program includes a direction setting button.

The user interface sub-program includes a landing button.

The primary object of the present invention is to provide an emitter and a method combined with a personal communication device for remote controlling remote-control toys.

The present invention combines the remote-control controller with the personal communication device to form the emitter connected to the personal communication device by using the 3.5 mm plug interface or 30-pin plug interface. The remote-control application program is activated on the personal communication device to send signals to control the remote-control toys. The users easily and conveniently control the remote-control toys without space for the conventional remote-control controller.

The remote-control application program includes a learning sub-program which accepts and combines multiple frequencies from different remote-control controllers, and provides multiple buttons to operate the frequencies to control different remote-control toys.

The present invention combines the remote-control application program with the g-sensor of the personal communication device to allow the user to swing the personal communication device to control the direction of the remote-control toys without touching the touch panel of the personal communication device.

The present invention provides a protection cover to be mounted to the personal communication device to prevent jamming or interference and to avoid the emitter from dropping.

The present invention will become more obvious from the following description when taken in connection with the accompanying drawings which show, for purposes of illustration only, preferred embodiments in accordance with the present invention.

DETAILED DESCRIPTION OF THE PREFERRED EMBODIMENTS

Figure 1:
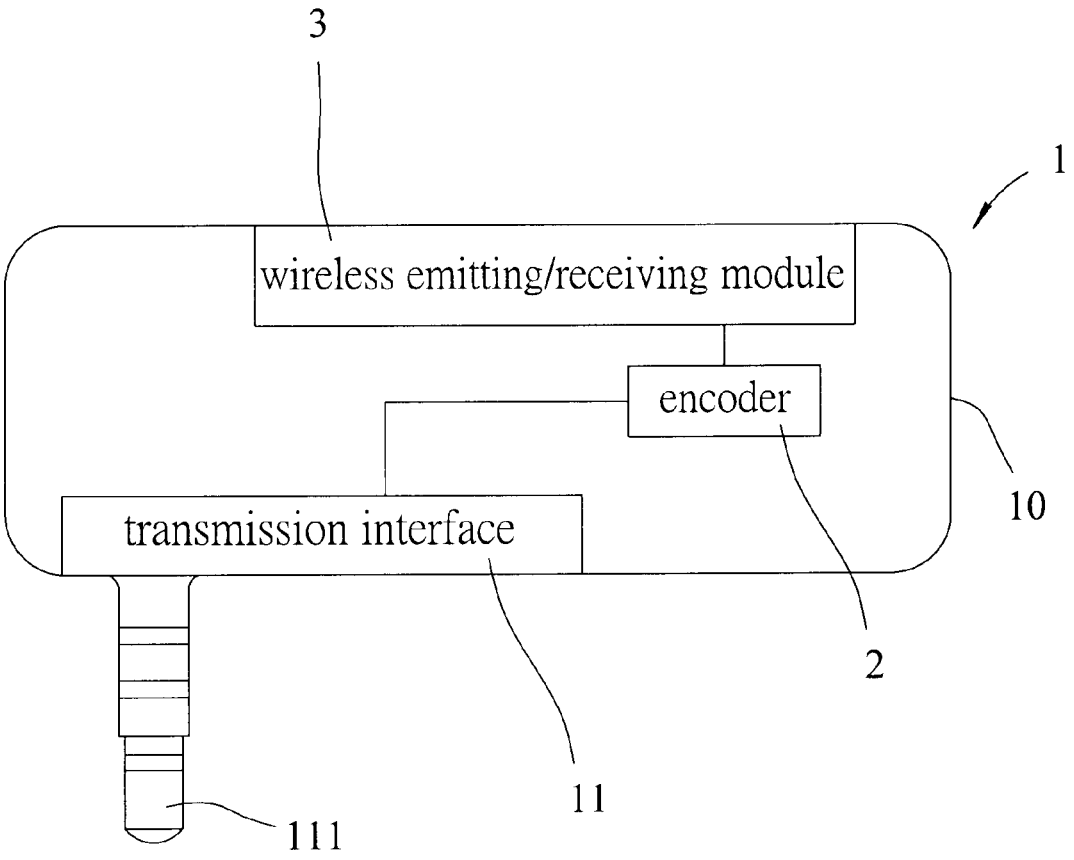
FIG. 1 shows the emitter of the present invention.
Figure 3:
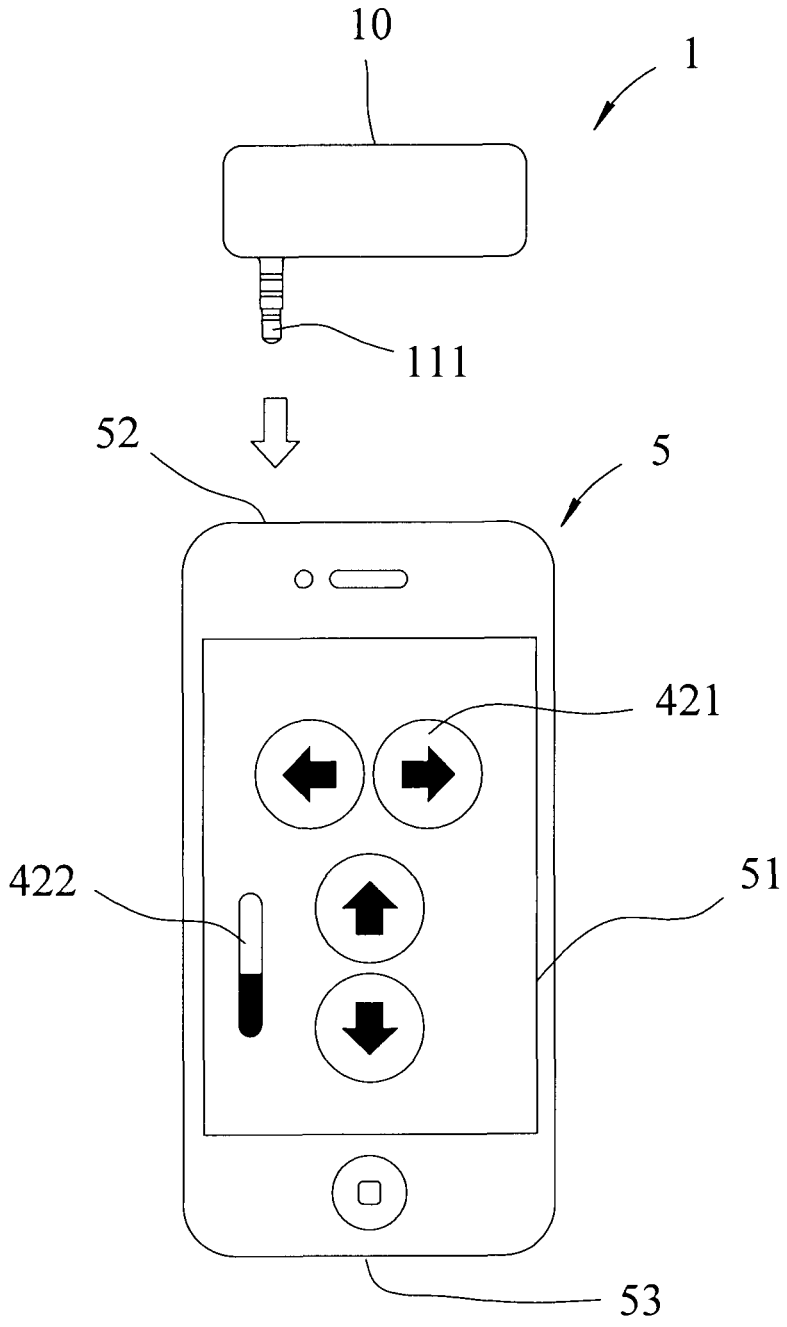
FIG. 3 shows the emitter connected to the personal communication device by using the 3.5 mm plug interface.
Figure 3A:
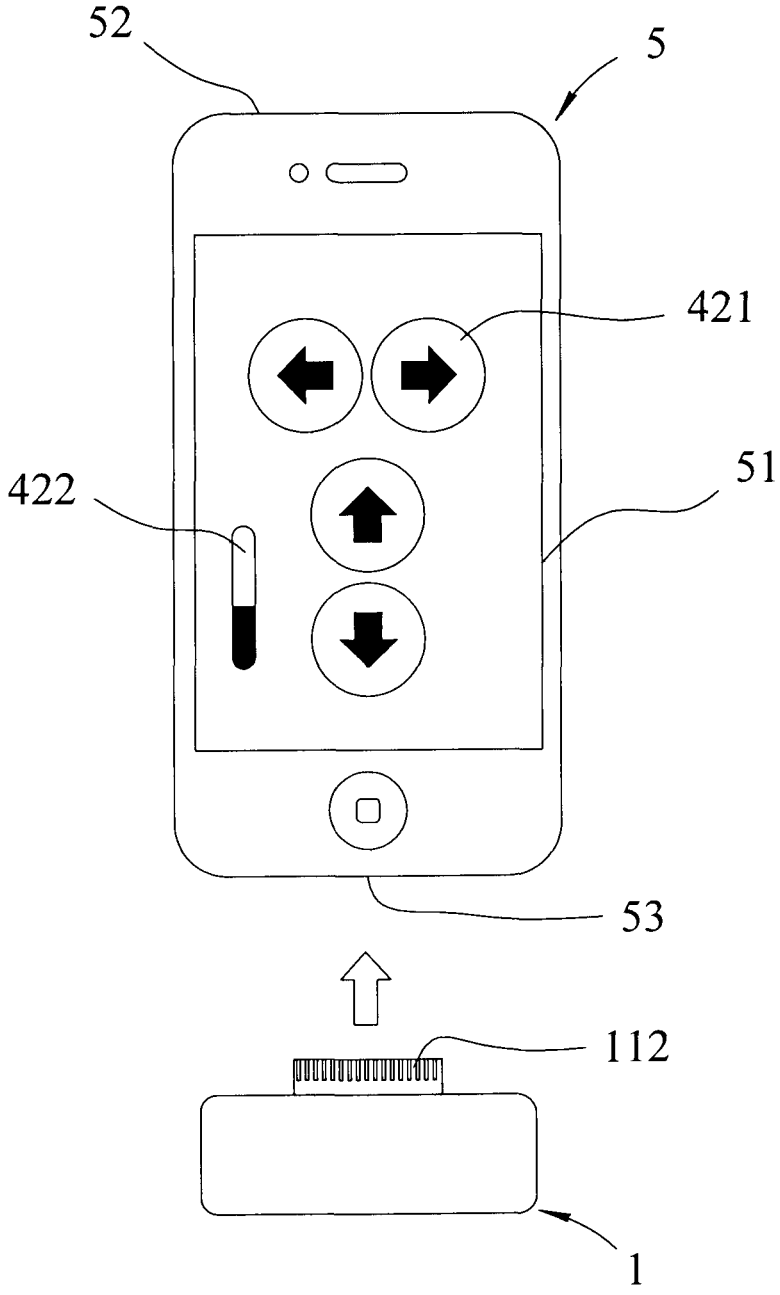
FIG. 3*a* shows the emitter connected to the personal communication device by using the 30-pin plug interface.

Referring to FIGS. 1, 3 and 3*a*, the present invention relates to a emitter combined with a personal communication device, and comprises an emitter 1 and a remote-control application program 4, The emitter comprises a transmission interface 11, an encoder 2 and a wireless emitting/receiving module 3, with all of the three parts received in a case 10. The transmission interface 11 protrudes from the case 10. The transmission interface 11 is a 3.5 mm plug interface 111 to be connected with the reception hole 52 or a 30-pin plug interface 112 to be connected with the reception hole 53 of the personal communication device 5. The personal communication device 5 receives the control signals and sends the control data to the encoder 2. The encoder 2 encodes the control data of the personal communication device 5 into control signals 7 which are sent to a wireless emitting/receiving module 3. The wireless emitting/receiving module 3 then sends the control signals 7 from the encoder 2 to the remote-control toys 8.

Figure 2:
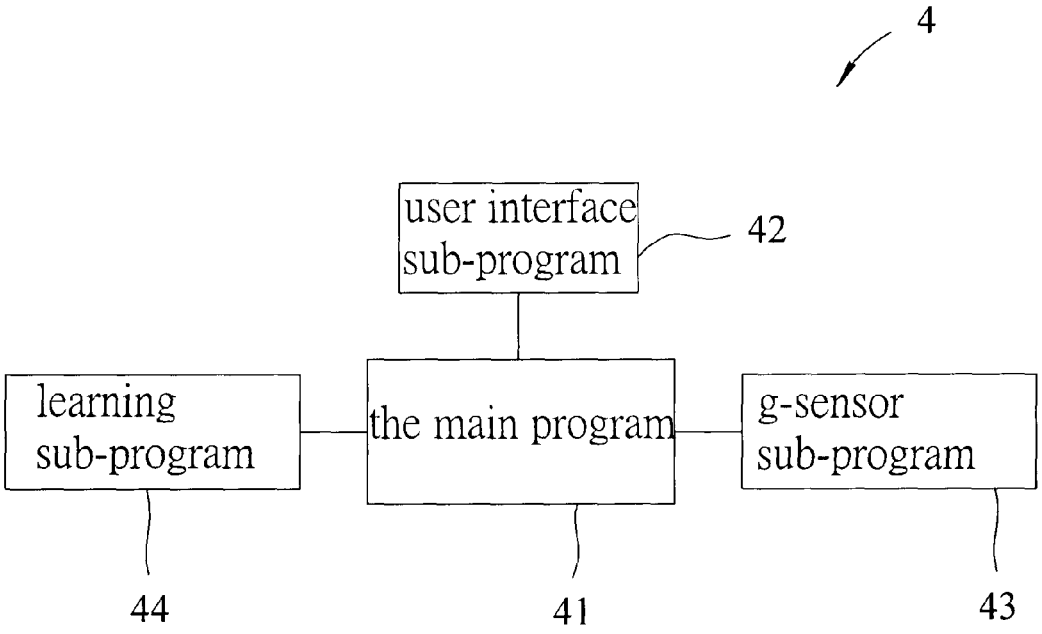
FIG. 2 shows the remote-control application program of the present invention.

As shown in FIGS. 2 and 3, the remote-control application program 4 is stored in the memory of the personal communication device 5, or is downloaded from a cloud operation system. The remote-control application program comprises a main program 41, a user interface sub-program 42 and a learning sub-program 44. The user interface sub-program 42 receives input signals from the buttons on the touch panel 51 of the personal communication device 5. The main program 41 receives the signals from the user interface sub-program 42, calculates and judges the signals, and sends the signals to the encoder 2 via the transmission interface 11 of the emitter 1 and the wireless emitting/receiving module 3 in sequence.

The user interface sub-program 42 includes multiple direction buttons 421, an acceleration button 422 and multiple frequency choosing buttons 423 displayed on the touch panel 51 of the personal communication device 5. The wireless emitting/receiving module 3 comprises a wireless receiver to receive different remote-control frequencies from other remote-control controllers. The learning sub-program 44 stores remote-control frequencies from the wireless receiver or other remote-control controllers into the memory of the personal communication device 5. The stored remote-control frequencies are activated by the learning sub-program 44 via the main program 41.

Figure 4:
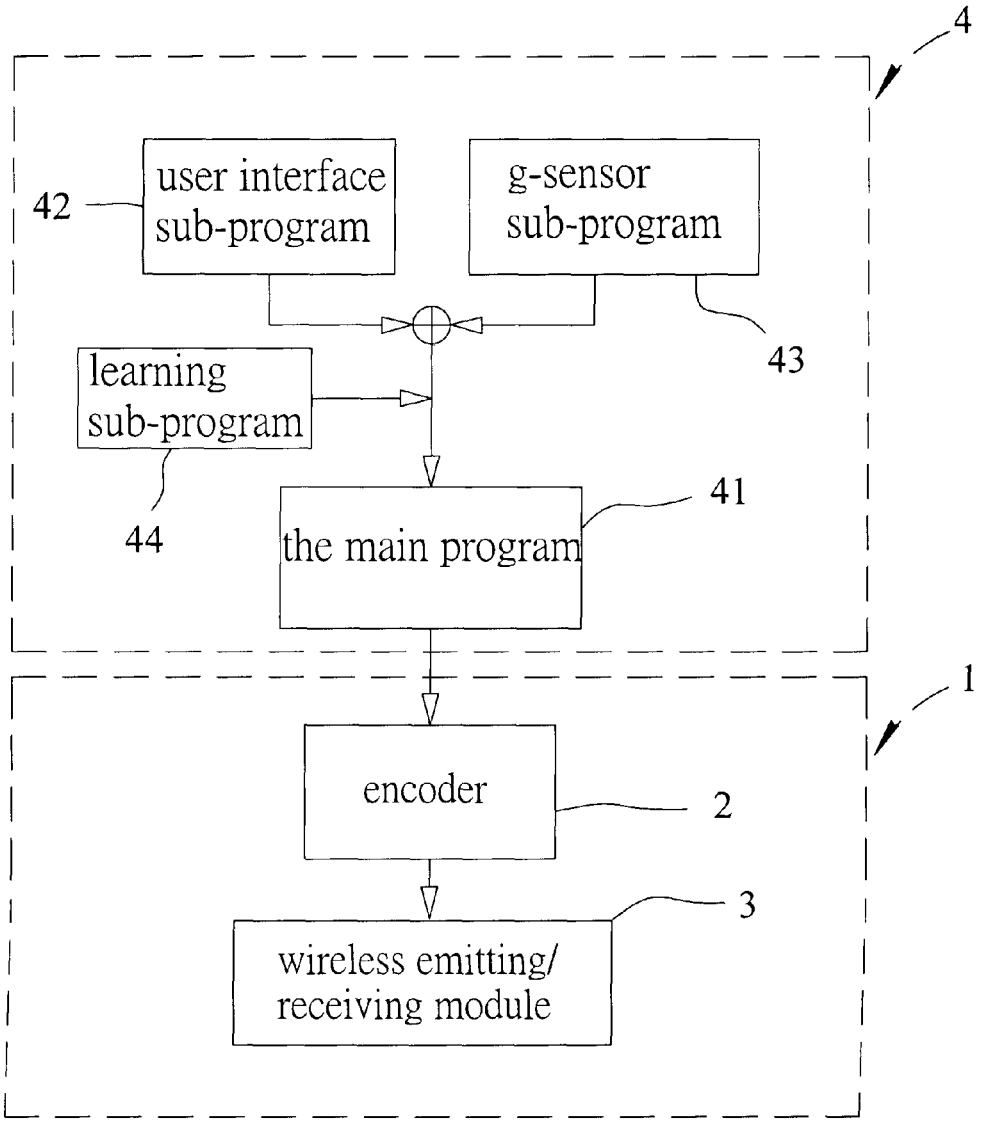
FIG. 4 shows the flow chart of the emitter and the remote-control application program.
Figure 5:
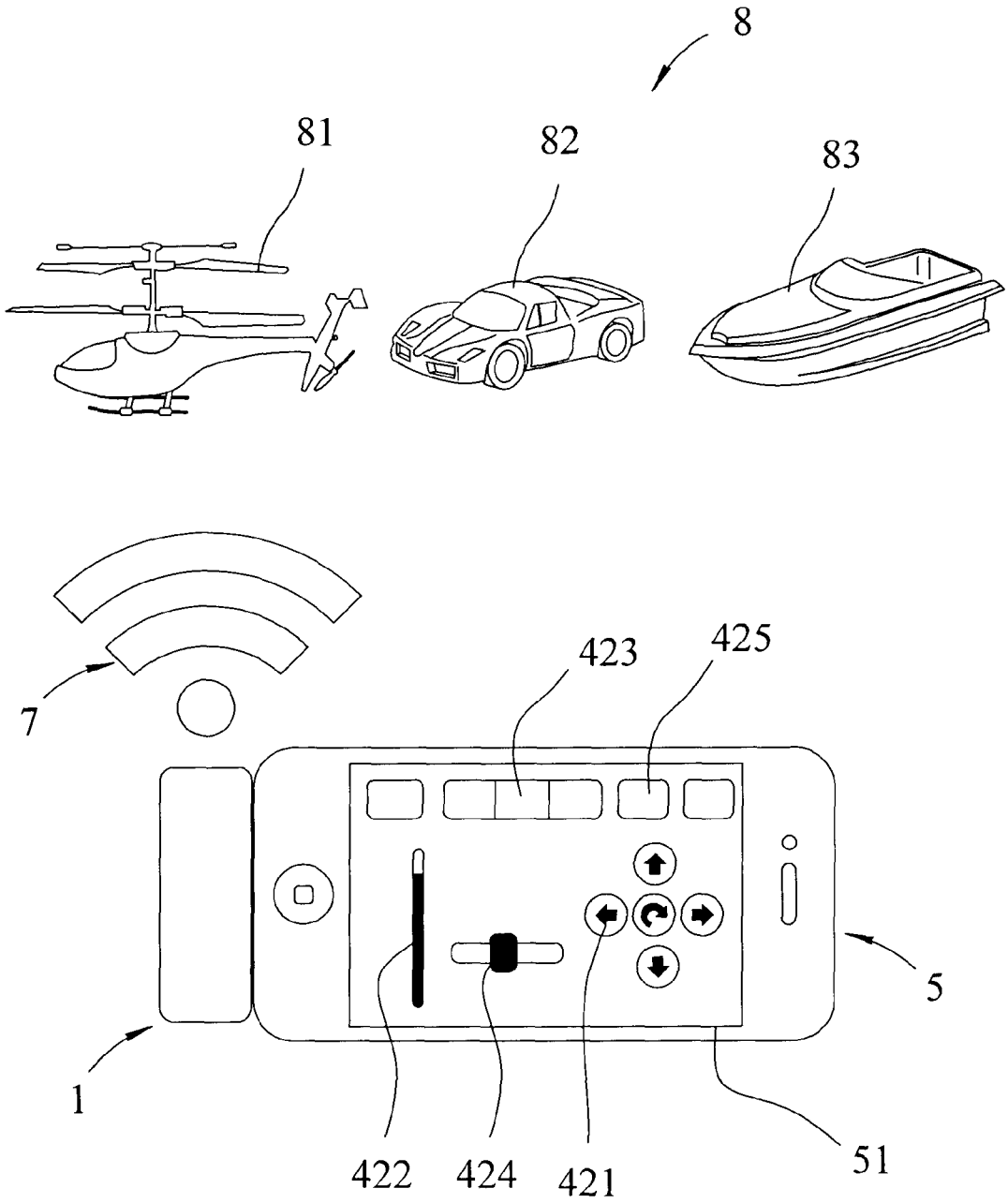
FIG. 5 shows the emitter of the present invention controlling multiple remote-control toys.

FIGS. 3 to 5 show that the control signals that the emitter 1 sends can be a fixed frequency which meets the requirement of the toy 8 so that the toy 8 is controlled. Nevertheless, different frequencies can also be sent by touching the touch panel of the personal communication device 5 such as an iPhone, an iPad,an iPod or other communication devices with a touch panel. The operation system can be Symbian, Windows Mobile, iOS, or Linux (including Android, Maemo, WebOS, Palm OS and BlackBerry OS). By matching the frequency with the toy 8, the personal communication device 5 can be a learning type or universal type remote-control controller. The emitter 1 is connected to the personal communication device 5 by connecting the 3.5 mm plug interface 111 or the 30-pin plug interface 112 to be connected with the reception hole 52 or 53 of the personal communication device 5, either with the fixed frequency or the operational frequency. The remote-control application program 4 stored in the personal communication device 5 is activated, and the main program 41 activates the user interface sub-program 42. The multiple direction buttons 421, the acceleration button 422 and frequency choosing buttons 423 are displayed on the touch panel 51.

A direction-setting button 424 can be touched to control the toys 8, such as remote-control helicopters 81, remote-control cars 82 and remote-control ships 83, to move in a specific direction. It is noted that if the toy 8 is a flying toy such as the remote-control helicopters 81, the user interface sub-program 42 includes a landing button 425 to control the toy 8 to slow down until landed.

As shown in FIGS. 4 and 5, the remote-control application program includes a g-sensor sub-program 43 which receives induction signals from the g-sensor of the personal communication device 5 and sends the induction signals to the main program 41. The toy 8 is controlled by swinging the personal communication device 5. For example, when the personal communication device 5 swings in an X direction, the toy 8 moves toward the X direction. When the personal communication device 5 swings in a Y direction, the toy 8 moves toward the Y direction without touching the direction button 421.

Figure 6:
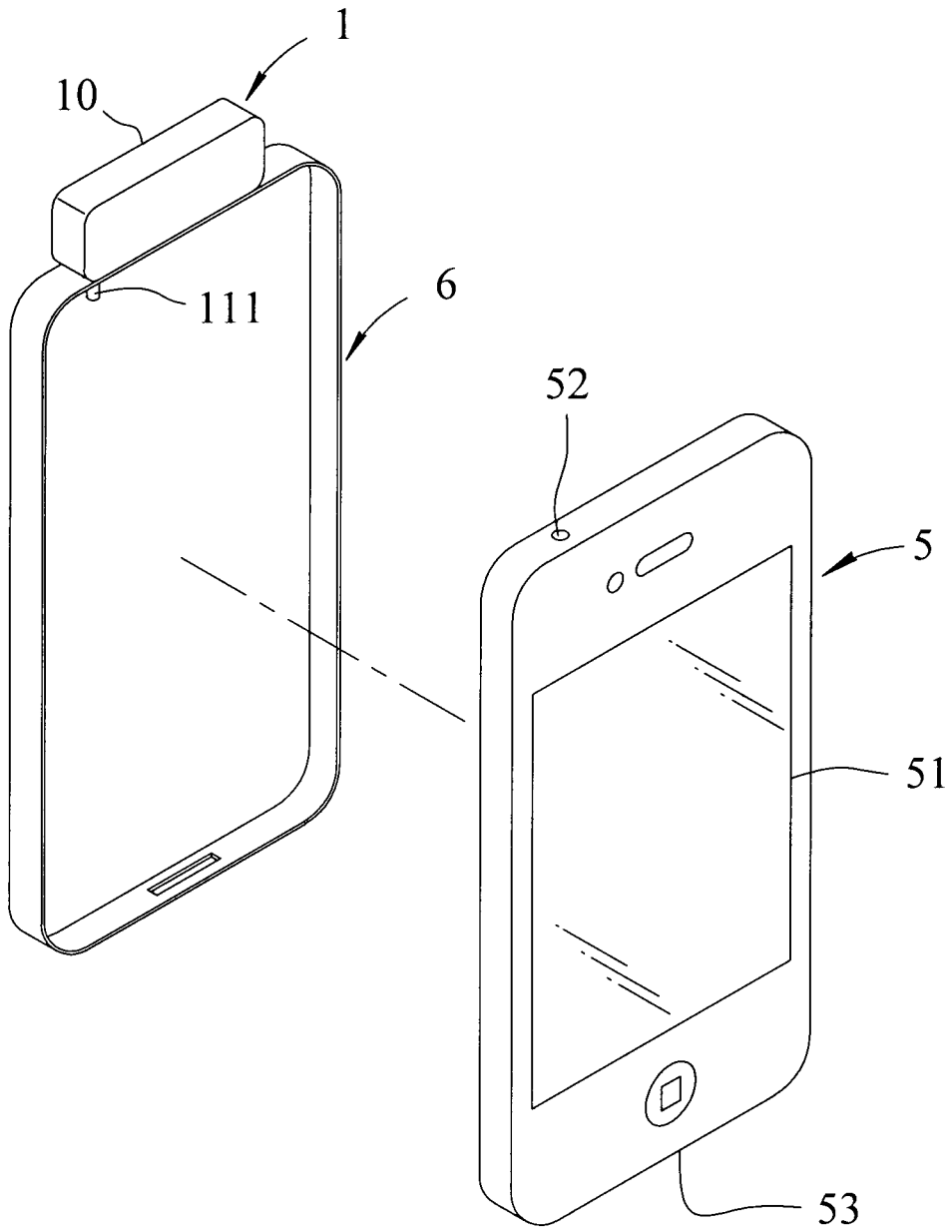
FIGS. 6 and 7 show the personal communication device connected with a protection cover.
Figure 7:
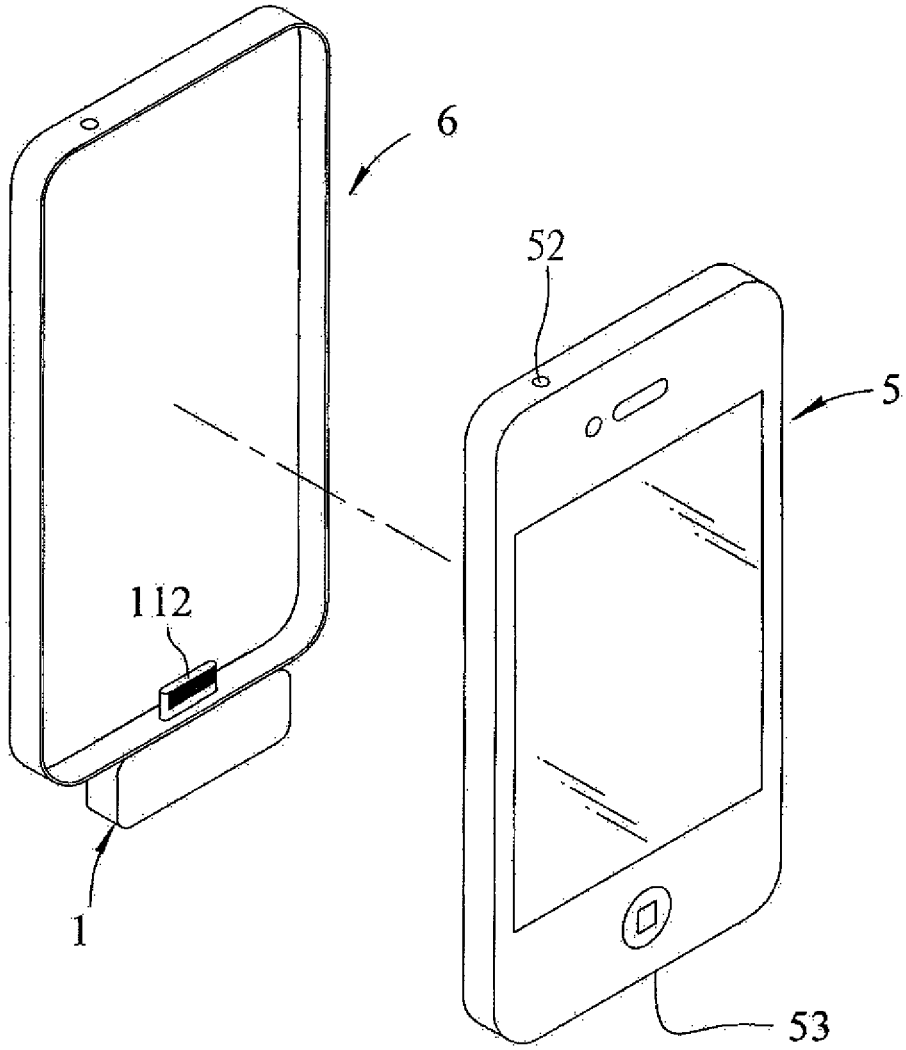

As shown in FIGS. 6 and 7, the protection cover 6 and the case 10 are integrally formed and the 3.5 mm plug interface 111 or the 30-pin plug interface 112 is located inside a long side of the personal communication device 5. The protection cover 6 is made by rubber. The 3.5 mm plug interface 111 or the 30-pin plug interface 112 is first connected to the personal communication device 5, and the protection cover 6 is mounted to the personal communication device 5. This can avoid interference of receiving signals and can avoid the emitter from dropping and being damaged.

Figure 8:
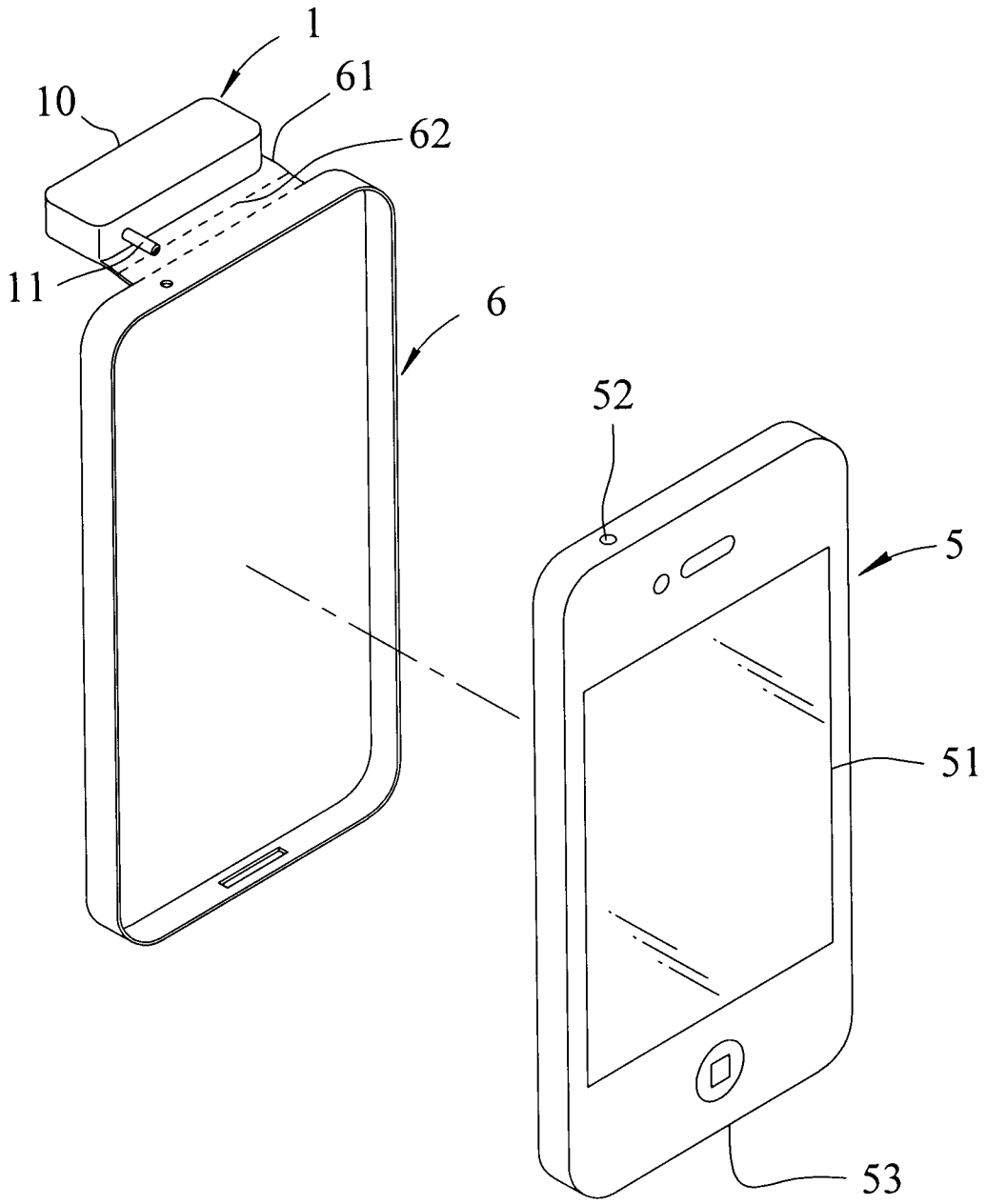
FIGS. 8 and 9 show the personal communication device connected with another embodiment of the protection cover.
Figure 9:
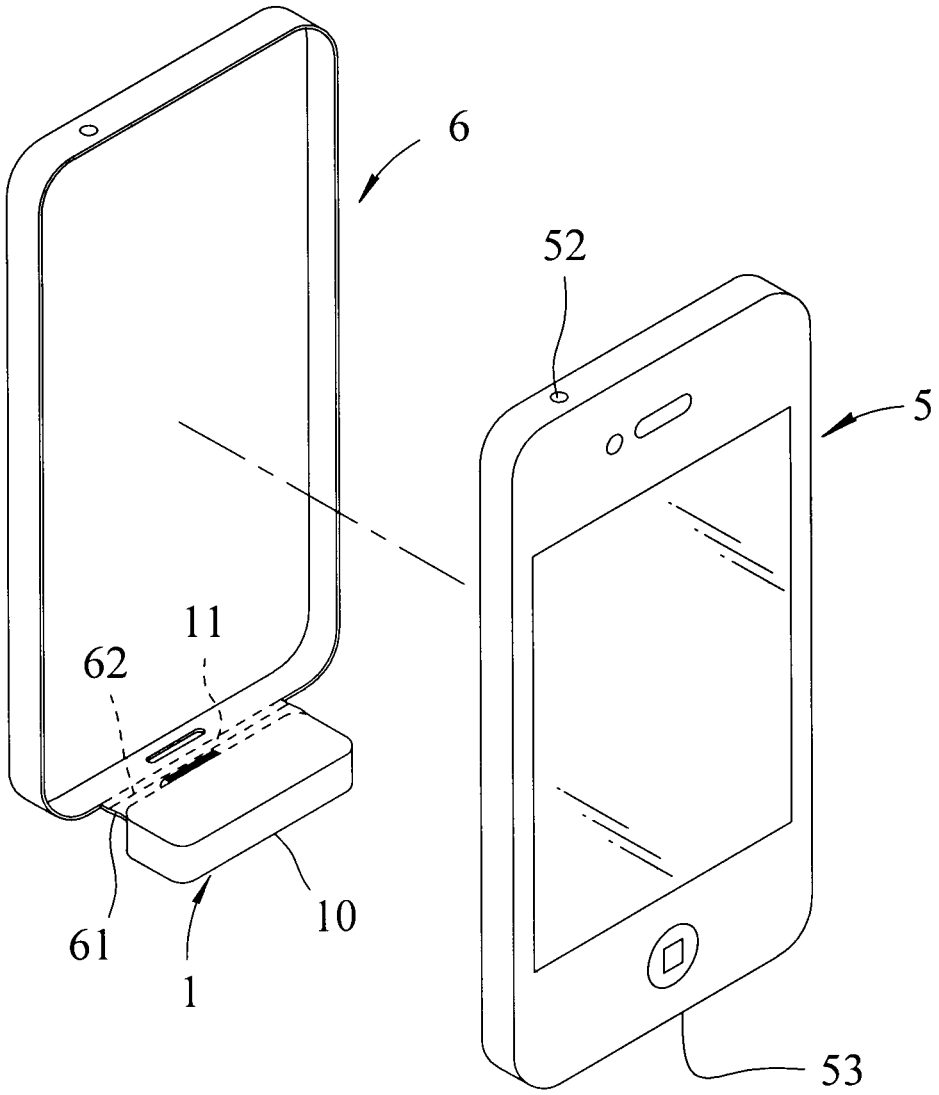
Figure 10:
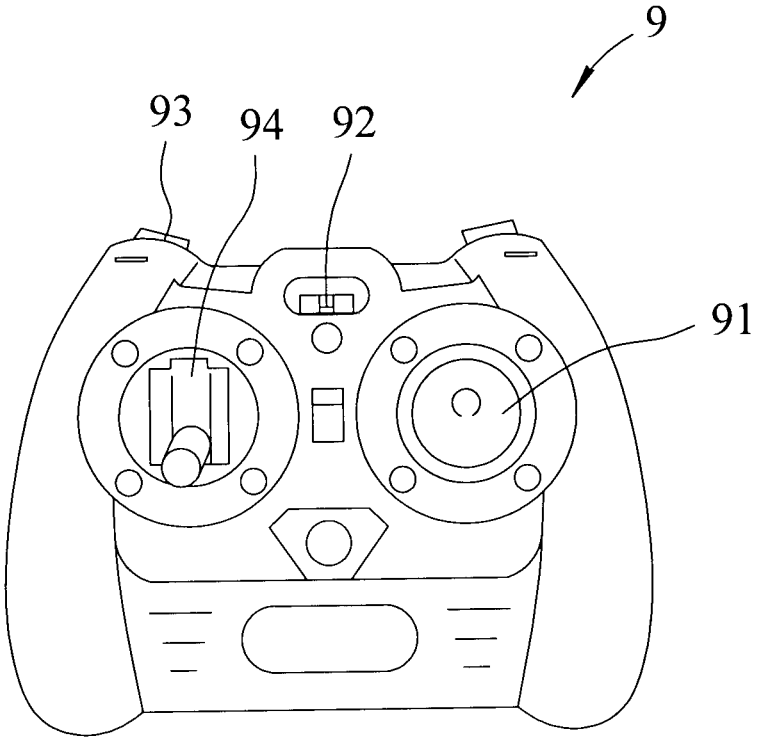
FIG.10 PRIOR ART
FIG. 10 shows the conventional remote-control controller.

As shown in FIGS. 8 and 9, the protection cover 6 can be made by a hard material such as Plastic, and a connection section 61 is located between the protection cover 6 and the case 10. The protection cover 6 includes a bending line 62. The transmission interface 11 is located at an angle relative to the long side of the personal communication device 5, and the transmission interface 11 is located outside of the protection cover 6. The protection cover 6 is easily mounted to the personal communication device 5, and the case 10 is rotated an angle to let the transmission interface 11 be inserted into the reception hole 53.

While embodiments in accordance with the present invention have been shown and described, it should be clear to those skilled in the art that further embodiments may be made without departing from the scope of the present invention.

What is claimed is:

1. A method of remote-control comprising:

inserting an exposed plug of an emitter into a reception hole of a personal communication device;

downloading a remote-control application program from pre-set or remote servos and stored in the personal communication device;

activating the remote-control application program via the personal communication device and the personal communication device sending a user interface sub-program to a touch panel of the personal communication device;

activating the user interface sub-program and the emitter emitting control signals to remote-control toys; and connecting a g-sensor interface sub-program to a g-sensor of the personal communication device, wherein the remote-control application program comprises a main program connected to the emitter of the personal communication device, wherein activating the user interface sub-program comprises activating the user interface sub-program and the g-sensor interface sub-program, and wherein the user interface sub-program stimulates multiple direction buttons and an acceleration button on the touch panel of the personal communication device.

2. The method as claimed in claim 1 further comprising mounting a protection cover to the emitter.

3. The method as claimed in claim 1, wherein the user interface sub-program includes a direction setting button.

4. The method as claimed in claim 3, wherein the user interface sub-program includes multiple frequency choosing buttons.

5. The method as claimed in claim 1, wherein the user interface sub-program includes a landing button.

6. The method as claimed in claim 1 further comprising connecting a learning sub-program with the emitter to receive and store a remote-control frequency from other remote-controllers.

7. An emitter connected with a personal communication device, comprising:

a transmission interface connected to the personal communication device and sending control data to an encoder;

a wireless emitting/receiving module, with the encoder encoding the control data of the personal communication device into control signals sent to the wireless emitting/receiving module, with the wireless emitting/receiving module sending the control signals from the encoder to remote-control toys; and a remote-control application program stored in memory of the personal communication device, or downloaded from a cloud operation system, with the remote-control application program comprising a main program and a user interface sub-program, with the user interface sub-program receiving input signals from buttons on a touch panel of the personal communication device, with the main program receiving signals from the user interface sub-program and calculating the control signals and sending the control signals to the encoder via a transmission interface of the emitter and the wireless emitting/receiving module in sequence.

8. The emitter as claimed in claim 7, further comprising a protection cover mounted to the personal communication device and secured to a case of the personal communication device, wherein the case includes the transmission interface, the encoder and the wireless emitting/receiving module, and wherein the transmission interface is a 3.5 mm plug interface or a 30-pin plug interface.

9. The emitter as claimed in claim 8, wherein the protection cover and the case are integrally formed, and wherein the transmission interface is located inside a long side of the personal communication device.

10. The emitter as claimed in claim 8, wherein the protection cover and the case are integrally formed, wherein the protection cover includes a bending line, wherein the transmission interface is located at an angle relative to a long side of the personal communication device, and wherein the transmission interface is located outside of the protection cover.

11. The emitter as claimed in claim 7, wherein the remote-control application program includes a g-sensor sub-program which receives induction signals from a g-sensor of the personal communication device and sends the induction signals to the main program.

12. The emitter as claimed in claim 7, wherein the wireless emitting/receiving module comprises a wireless receiver, wherein the remote-control application program includes a learning sub-program, wherein the learning sub-program stores remote-control frequencies from the wireless receiver or other remote-control controllers into the memory of the personal communication device, and wherein the remote-control frequencies are activated by the learning sub-program via the main program.

13. The emitter as claimed in claim 12, wherein the user interface sub-program includes multiple direction buttons, an acceleration button and multiple frequency choosing buttons displayed on the touch panel of the personal communication device.

14. The emitter as claimed in claim 12, wherein the user interface sub-program includes a direction setting button.

15. The emitter as claimed in claim 12, wherein the user interface sub-program includes a landing button.

* * * * *